US006052549A

United States Patent [19]

Shimura et al.

[11] Patent Number: 6,052,549

[45] Date of Patent: Apr. 18, 2000

[54] CHARGING ROLLER, AND PROCESS CARTRIDGE AND IMAGE-FORMING APPARATUS EMPLOYING THE ROLLER

[75] Inventors: Masaru Shimura; Masaharu Ohkubo, both of Yokohama; Takayasu Yuminamochi, Kawasaki, all of Japan

[73] Assignee: Canon Kabushiki Kaisha, Tokyo, Japan

[21] Appl. No.: 08/562,366

[22] Filed: Nov. 22, 1995

[30] Foreign Application Priority Data

Nov. 25, 1994 [JP] Japan ..... 6-291200
Jul. 18, 1995 [JP] Japan ..... 7-181833

[51] Int. Cl.[7] ..... G03G 15/02

[52] U.S. Cl. ..... 399/176; 361/221

[58] Field of Search ..... 355/219; 430/902; 361/214, 221, 225; 399/176

[56] References Cited

U.S. PATENT DOCUMENTS

| | | | |
|---|---|---|---|
| 5,089,851 | 2/1992 | Tanaka et al. | 355/219 |
| 5,235,386 | 8/1993 | Yano et al. | 355/219 |
| 5,471,285 | 11/1995 | Nagase et al. | 355/219 |
| 5,499,078 | 3/1996 | Kurokawa et al. | 355/219 X |
| 5,543,899 | 8/1996 | Inami et al. | 355/219 |
| 5,567,494 | 10/1996 | Ageishi et al. | 355/219 X |
| 5,610,691 | 3/1997 | Takahashi et al. | 399/176 |
| 5,619,311 | 4/1997 | Kurokawa et al. | 399/176 |

FOREIGN PATENT DOCUMENTS

| | | |
|---|---|---|
| 2-198468 | 8/1990 | Japan . |
| 7-128958 | 5/1995 | Japan . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A charging roller is set in contact with a chargeable member to charge the chargeable member by application of voltage. The charging roller has an electroconductive support, an elastic layer formed thereon, and at least one coating layer formed on the elastic layer. The charging roller has surface roughness of not more than 8 $\mu$m, and Asker C hardness (A) of the elastic layer, and micro-rubber hardness (B) of the charging roller satisfy the relations below:

$A \leqq 45°$ $A < B < A + 20°$.

15 Claims, 5 Drawing Sheets

CHARGING ROLLER, AND PROCESS CARTRIDGE AND IMAGE-FORMING APPARATUS EMPLOYING THE ROLLER

BACKGROUND OF THE INVENTION

1. Field of the Invention

The present invention relates to a charging roller, which is applicable to electrical charging in an electrophotographic image-forming apparatus, and which is used in contact with a chargeable member (or a charge-receiving member) to charge it electrically by application of voltage. The present invention also relates to a process cartridge and an image-forming apparatus employing the charging roller.

2. Related Background Art

Conventionally, for electrophotographic image-forming apparatuses, a corona charger is used as the primary charging device for the image-holding photosensitive member, which applies a high voltage to a wire to cause corona discharge toward the chargeable member. In recent years, a contact type of charger is being developed which is used in direct contact with the chargeable member to charge the surface of the chargeable member by application of voltage. The contact charging is advantageous in that the required voltage is low for obtaining a necessary surface potential of the chargeable member and ozone is generated less at the charging process in comparison with the non-contact corona charging. In particular, roller charging with an electroconductive roller as the charging member is widely used owing to stability of the electrical charging.

FIG. 12 illustrates an example of a charging roller employed in a conventional electrophotographic image-forming apparatus.

A charging roller 110 is constituted of an electroconductive axis 111 serving also as a power supplying electrode, an elastic layer 112, and a coating layer 113. Conventionally, the elastic layer 112 is made from a solid rubber such as styrene-butadiene rubbers (SBR), isoprene rubbers, and silicone rubbers, and the coating layer 113 is made from a resin or a rubber such as polyamide resins, hydrin rubbers, urethane rubbers, and silicone rubbers. The charging roller is liable to generate noises in combination with the photosensitive member on application of an AC bias. In order to reduce noise, various efforts have been made such as filling empty spaces of the photosensitive member with weights, use of a sponge material as an elastic layer, and use of a resin tube as a coating layer.

However, the above-described conventional charging roller has a high hardness, and the one employing a sponge has a rough surface. Therefore, the boundary of the discharge region on the charged photosensitive member is not sufficiently linear in the length direction, as that shown in FIG. 4 where the numeral 42 indicates a discharge region, and the numeral 41 indicates the region opposing the nip portion between a photosensitive member and a charging roller. Such a non-uniform discharge tends to cause non-uniform wearing of the surface of the photosensitive member during repeated use, resulting in shortening of the life of the photosensitive member as the result of wear. In a high processing speed, in particular, a higher frequency of an AC bias is applied (1000 Hz or more) to allow a large electric discharge current to flow between the photosensitive member and the charging roller, which damages the photosensitive member more greatly to render the above-noted disadvantage more serious.

SUMMARY OF THE INVENTION

The present invention intends to provide a charging roller which causes less wearing of the photosensitive member to lengthen the life thereof. The present invention also intends to provide a process cartridge and an image-forming apparatus employing the charging roller.

According to an aspect of the present invention, there is provided a charging roller set in contact with a chargeable member and charging the chargeable member by application of voltage, the charging roller comprising an electroconductive support, an elastic layer formed thereon, and at least one coating layer formed on the elastic layer, wherein the charging roller has surface roughness of not more than 8 $\mu$m, and Asker C hardness (A) of the elastic layer and micro-rubber hardness (B) of the charging roller satisfy the relations below:

$$A \leq 45^\circ$$

$$A < B < A + 20^\circ.$$

According to another aspect of the present invention, there is provided a process cartridge employing the above charging roller.

According to a further aspect of the present invention, there is provided an image-forming apparatus employing the above charging roller.

DETAILED DESCRIPTION OF THE PREFERRED EMBODIMENTS

The charging roller of the present invention is set in contact with a chargeable member and charges the chargeable member electrically by application of voltage, and comprises an electroconductive support, an elastic layer formed thereon, and at least one coating layer formed on the elastic layer, wherein the charging roller has a surface roughness of not more than 8 pm, and Asker C hardness (A)

of the elastic layer and a micro-rubber hardness (B) of the charging roller satisfy the relations below:

$$A \leqq 45°$$

$$A<B<A+20°.$$

Figure 3:
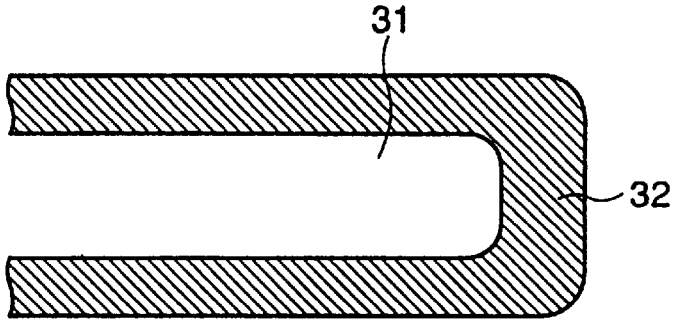
FIG. 3 illustrates a discharge track pattern on a photosensitive member in the present invention.

The above constitution of the charging roller makes the shape of the discharge region (the discharge track pattern) on the photosensitive member nearly linear in the length direction of the photosensitive member as shown in FIG. 3, where the numeral 32 indicates a discharge region, and the numeral 31 indicates an area opposing to the nip between a photosensitive member and a charging roller. Thereby, wearing of the photosensitive member surface is reduced and the life of the photosensitive member is lengthened.

Figure 4:
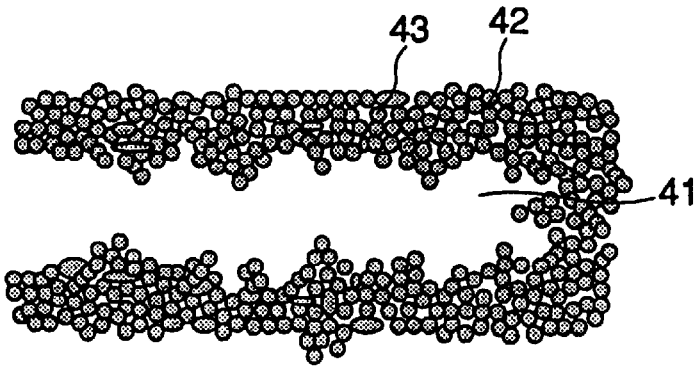
FIG. 4 illustrates a discharge track pattern on a photosensitive member with a charging roller having a large surface roughness.

With the surface roughness of larger than 8 μm, the charging roller will not form a nearly linear pattern of the discharging region like the one shown in FIG. 3, but will form a pattern having an irregular boundary between a nip portion 41 and a discharge area 42 as shown in FIG. 4 owing to the irregular surface of the charging roller. Furthermore, such a charging roller will cause locally concentrated spots of discharge as shown by the numeral 43 in FIG. 4, which will accelerate the wearing of the photosensitive member surface.

Figure 5:
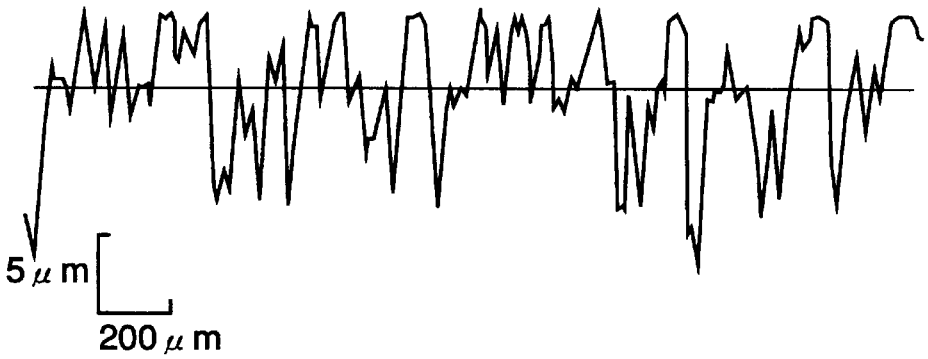
FIG. 5 is a schematic illustration of the surface of a photosensitive member having been subjected to non-uniform discharge.
Figure 6:
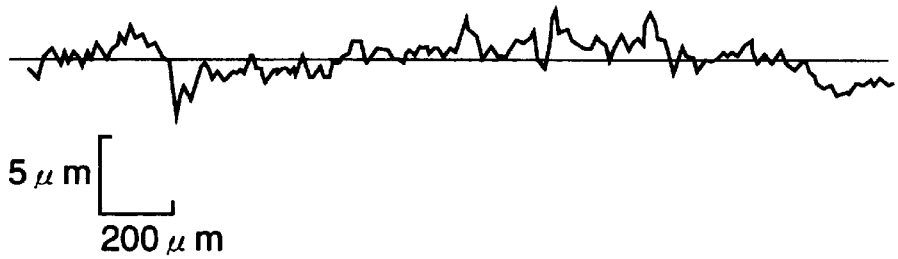
FIG. 6 is a schematic illustration of the surface of a photosensitive member which has been used in combination with a charging roller of the present invention.

FIG. 5 shows a schematic illustration of the surface of a photosensitive member used repeatedly under a non-uniform discharge. FIG. 6 shows a schematic illustration of the surface of a photosensitive member used in combination with the charging roller of the present invention. As shown in FIG. 5, the non-uniformly worn surface by a non-uniform discharge is abraded by a cleaning blade more greatly than that of the uniformly worn surface shown in FIG. 6.

Figure 7:
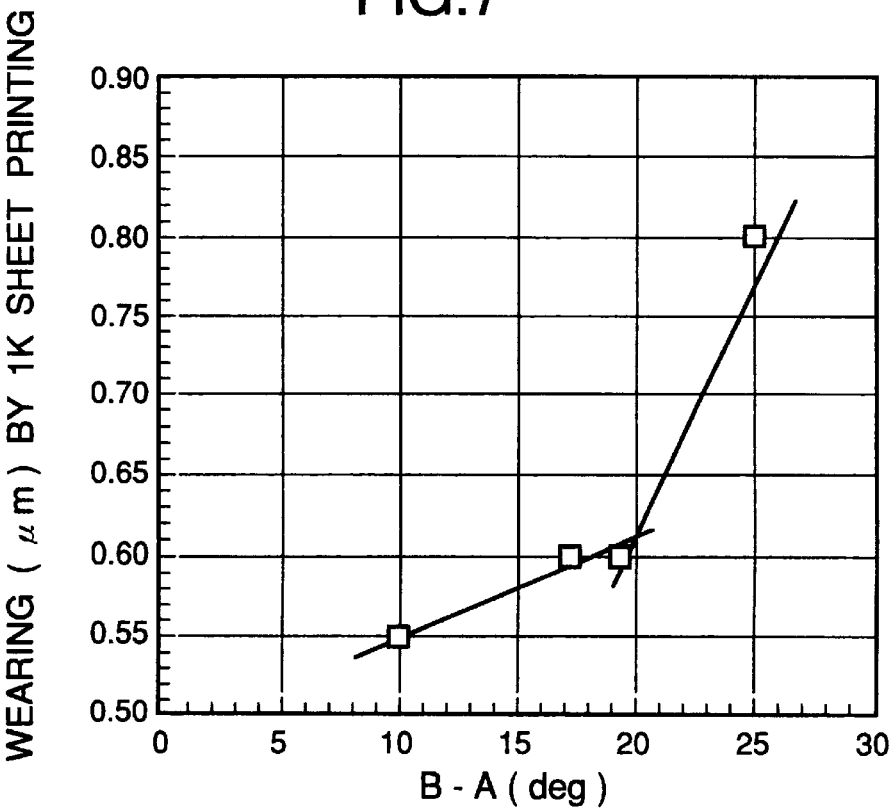
FIG. 7 shows dependence of the wearing of the photosensitive member by 1000 sheets of printing on the hardness difference (B−A).
Figure 8:
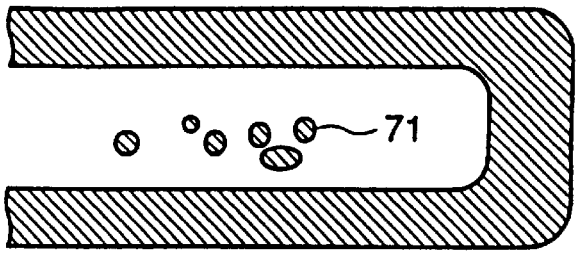
FIG. 8 shows a discharge track pattern when the hardness conditions of the present invention are not satisfied.

When the Asker C hardness (A) and the micro-rubber hardness (B) of the charging roller after the entire layer formation do not satisfy the relation below:

$$A<B,$$

the elastic layer will not be deformed sufficiently, thereby tending to give an interspace at the contacting portion (nip portion) between the charging roller and the photosensitive member, even if the condition of the surface roughness of not more than 8 μm is satisfied. Further, when the relation:

$$B<A+20°$$

is not satisfied, the coating layer has a hardness excessively higher than the elastic layer, thereby the elastic layer only is deformed without the necessary deformation of the coating layer to give an interspace at the contacting portion (nip portion) between the charging roller and the photosensitive member. In particular, the difference between the Asker C hardness (A) of the elastic layer and the micro-rubber hardness (B) of the charging roller after the coating layer formation affects the wearing of the surface of the photosensitive member as shown by the dependence of the wearing of the photosensitive member on the difference of (B−A) in FIG. 7 which was obtained from Examples and Comparative Examples. FIG. 7 shows that the larger difference of (B−A) of tends to cause an increase of the wearing, the relation curve changes its gradient at the value of (B−A) of about 20°, and the wearing of the photosensitive drum surface becomes especially greater in the range of $B-A \geqq 20°$. Further, when the relation:

$$A \leqq 45°$$

is not satisfied, the hardness of the charging roller becomes excessively high as a whole, thereby deformation as a whole of the charging roller will be small, and tends to form an interspace between the contact portion (nip portion) between the charging roller and the photosensitive member. The interspace at the contact portion (nip portion) between the charging roller and the photosensitive member will cause an island-like discharge region 71 at the nip portion as shown in FIG. 8. The island-like discharge region 71 will increase the discharge area and concentrate the discharge locally, which accelerates local damage of the photosensitive member similarly as in the case of the surface roughness of 8 μm to increase wearing of the photosensitive member.

The surface roughness of the charging roller in the present invention is not more than 8 μm, and in view of the ease of the production, the roughness is not less than 0.1 μm, more preferably in the range of from 0.1 to 3 μm.

The Asker C hardness of the elastic layer is not higher than 45°, and in view of the ease of the production, the hardness is preferably in the range of from 10 to 45°, more preferably from 20 to 45°.

The micro-rubber hardnesses of all the layers are more than 45° but is lower than 65°, preferably in the range of from more than 45° but not more than 55°.

The surface roughness in the present invention is measured by a 10-point average roughness test method according to JIS B0601. Practically the surface roughness is measured by Surfcorder (Model SE3300, KOSAKA Laboratory K.K.) by the 10-point average method at 12 spots (4 spots in the peripheral direction and 3 spots in the length direction) with a measuring length of 2.5 mm respectively of the charging roller, and averaging the obtained twelve 10-point average values.

The Asker C hardness is measured by a spring type Asker C hardness meter (manufactured by Kobunshi Keiki K.K.) according to JIS K6050. In the present invention, the hardness was measured under a load of 500 g directly for an unfinished charging roller constituted of an electroconductive support and an elastic layer only on the electroconductive support without providing a coating layer.

The micro-rubber hardness was measured directly for a completed charging roller having all the intended layers by use of Micro-durometer (Model MD-1, Kobunshi Keiki K.K.).

Figure 2:
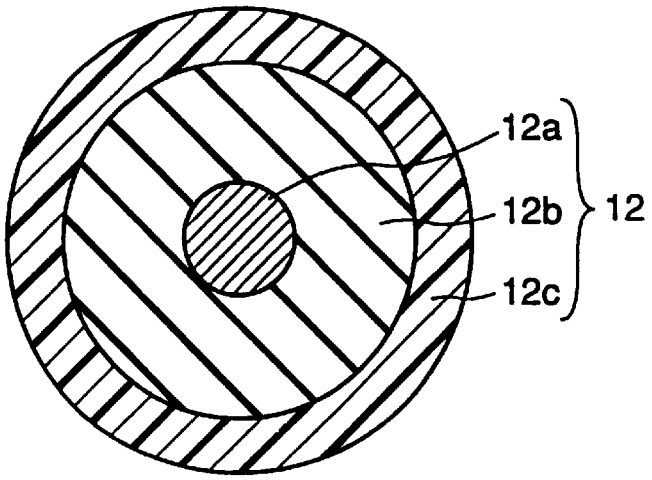
FIG. 2 is a schematic sectional view of a charging roller of the present invention.

FIG. 2 shows a schematic sectional view of a charging roller 12 of the present invention, which is constituted of an electroconductive support 12*a* of 8 mm in diameter serving also as a power-supplying electrode, an elastic layer 12*b* formed on the support, and a coating layer 12*c* formed further thereon. The outside diameter of the charging roller is 14.0 mm.

The elastic layer 12*b* may be formed from any material which satisfies the above-mentioned properties. The material includes ethylene-propylenediene terpolymers (EPDM), silicone rubbers, urethane rubbers, and epichlorohydrin rubbers. The material is preferably an expanded and vulcanized sponge of the above resin or the rubber so as to satisfy the condition of $A \leqq 45°$.

The thickness of the elastic layer ranges preferably from 2.0 to 10 mm. The larger thickness thereof tends to result in a higher resistivity, and the smaller thickness tends not to give the required low hardness. The electroconductivity of the elastic layer is adjusted preferably by incorporating an electroconductive material such as carbon black, metals, and metal oxides into the elastic layer.

The coating layer 12*c* is provided on the elastic layer 12*b*, and has functions of preventing exudation of an oil from the elastic layer 12*b*, uniformizing the resistivity of the elastic layer 12*b* by leveling the irregularity of the resistivity thereof, protecting the surface of the charging roller 12, and adjusting the hardness of the charging roller.

The coating layer 12*c* may be made from any material which satisfies the aforementioned property conditions. The coating layer may be either a single layer or a combination of layers. The material includes hydrin rubbers, urethane rubbers, nylon resins, and so forth. The coating layer 12*c* has a thickness preferably ranging from 100 to 1000 μm, and a resistivity ranging from $10^5$ to $10^9$ Ω·cm. The resistivity is preferably made higher at the layer portion closer to the surface. The resistivity can be adjusted by incorporating an electroconductive material such as carbon black, metals, and metal oxides into the coating layer.

Figure 1:
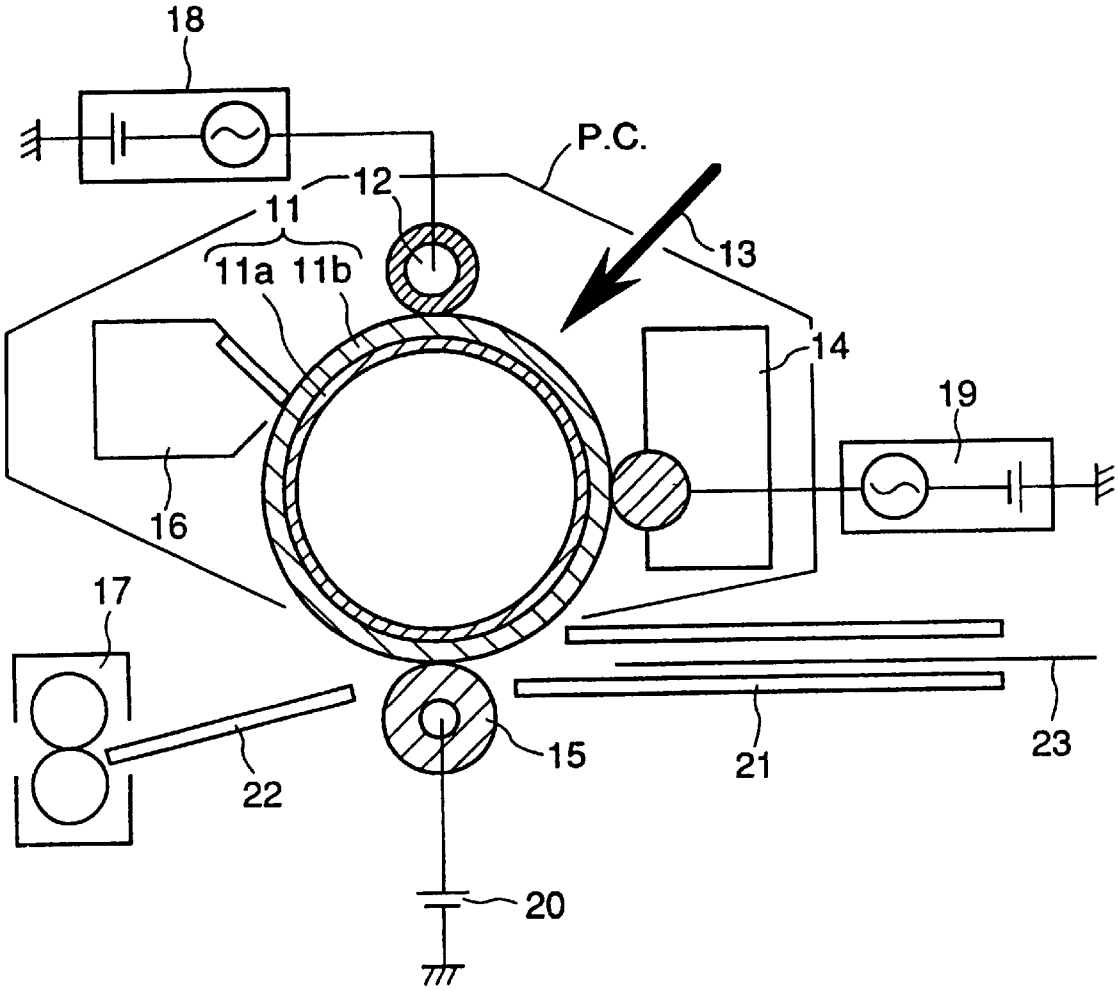
FIG. 1 illustrates schematically a constitution of an image-forming apparatus employed in the example of the present invention.

FIG. 1 illustrates schematically a laser beam printer which is an image-forming apparatus of the present invention.

In FIG. 1, the image-forming apparatus is constituted mainly of an electrophotographic photosensitive member 11 comprising an electroconductive support 11*a* and a photosensitive layer 11*b* formed thereon; a charging roller 12 of the present invention connected to a charging power source 18 for applying a pulse voltage composed of a DC voltage superposed with an AC voltage; exposure light 13; a developing device 14 connected to a developing power source 19; a transfer device 15 connected to a transfer power source 20; a cleaner 16, a paper sheet delivery guides 21, 22, and a fixation device 17.

In the image-forming apparatus having the above constitution, the photosensitive member 11 rotates in a predetermined direction. The charging roller 12 is press-contacted to the photosensitive member 11 to be driven to rotate therewith, and uniformly charges the surface of the photosensitive member 11 electrically. Then, exposure light 13 is projected from an image light exposure device (not shown in the drawing) to form an electrostatic latent image on the photosensitive member 11. The formed electrostatic latent image is developed into an image of a toner, a developing powder, by the developing device 14. The toner image is transferred onto a transfer-receiving sheet 23 delivered by a delivery guide 21 to the interspace between the photosensitive member 11 and the transfer roller 15. Then the transfer-receiving sheet 23 is delivered by passing over the face of a delivery guide 22 to a fixation device 17. There, the toner image is fixed on the transfer-receiving sheet 23 as the toner image by press-heating in the fixation device 17. The excess toner remaining on the photosensitive member 11 is recovered by the cleaner 16.

In the present invention, some of the constitutional elements including the photosensitive member 11, the charging roller 12, the development device 14, and the cleaner 16 may be integrated into a process cartridge, and the process cartridge may be mounted detachably onto a main body of the image-forming apparatus such as a copying machine or a laser beam printer. For example, at least one of the development device 14 and the cleaner 16 is integrated with the photosensitive member 11 and the charging roller 12 into a cartridge, and is mounted by means of a guide means such as a rail provided in the main body of the image-forming apparatus as a demountable process cartridge.

EXAMPLE 1 AND COMPARATIVE EXAMPLE 1

An organic photosensitive member was employed which was constituted of an aluminum cylinder of 30 mm in diameter, a sublayer formed on the aluminum cylinder, a charge-generating layer formed on the sublayer, and a charge-transporting layer containing a bisphenol Z type polycarbonate resin as the binder resin formed on the charge-generating layer. This photosensitive member was mounted on a laser beam printer having a processing speed of about 100 mm/sec. An A3-sized image was printed repeatedly by bringing a charging roller mentioned below into contact with the photosensitive member with the application of an AC voltage of frequency of 1000 Hz and peak-to-peak voltage ($V_{PP}$) of 2500 V, and a DC voltage of about −700 V in superposition, and with a contact pressure of 1350 g applied by a spring force of 500 g on each side and the inherent weight of the charging roller.

Figure 9:
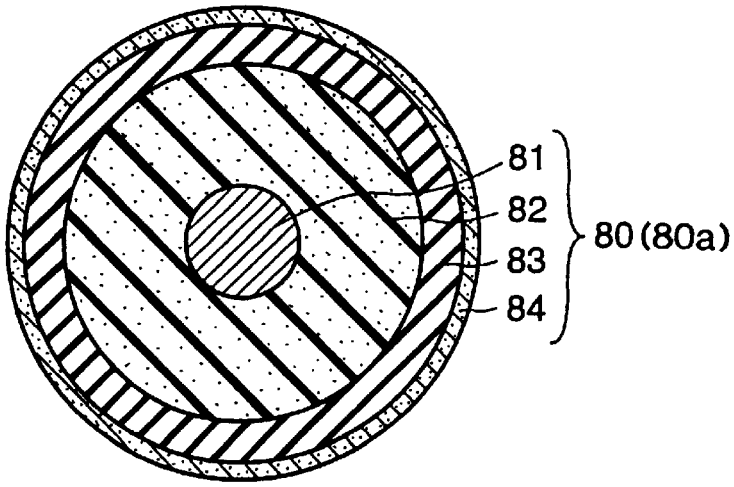
FIG. 9 is a schematic sectional view of the charging roller employed in Example 1.

FIG. 9 is a sectional view showing the layer constitution of the charging roller 80 of the present invention. This charging roller 80 has three layers: an elastic layer 82, a coating layers 83, 84 arranged in the named order successively on an electroconductive support 81 serving also as a power-supplying electrode, and is about 14 mm in outside diameter and 310 mm in length. The charging roller 80 is prepared by co-extrusion of the elastic layer 82 and the coating layer 83, expanding and vulcanizing it, and then forming the coating layer 84 by roll coating.

In the constitution shown in FIG. 9, the electroconductive support 81 is a nickel-plated steel bar of 8 mm in diameter, the elastic layer 82 is an expanded and vulcanized EPDM sponge containing electroconductive carbon black dispersed therein, having thickness of 2.5 mm and resistivity of $10^6$ Ω·cm. The coating layer 83 is a hydrin rubber containing electroconductive tin oxide dispersed therein and having thickness of 250 μm and resistivity of $10^7$ Ω·cm. The coating layer 84 is a nylon resin containing electroconductive carbon black dispersed therein and having thickness of 10 μm, and resistivity of $10^8$ Ω·cm.

The coating layer 83 is employed to prevent exudation of oil from the elastic layer 82 and to level the non-uniform resistivity of the elastic layer. The coating layer 84 serves to raise the pressure resistance against the photosensitive member, to prevent soiling of the surface of the photosensitive member by the coating layer 83, and to protect the surface of the charging roller 80.

The surface roughness (10-point average roughness) of 8 μm or less of the charging roller 80 was obtained by decreasing the surface roughness of the coating layer 83 by raising the hardness thereof. As the results, the charging roller after formation of the coating layer 84 had a surface roughness of 6 μm.

Separately, another charging roller 80*a* was prepared in the same manner as the above charging roller 80 except that hardness of the coating layer 83 was not raised. This charging roller 80*a* had a surface roughness of 10 μm.

Table 1 shows the hardnesses A and B, and the amounts of wearing of the photosensitive member surface by printing with the above two charging rollers. The amount of wearing of the photosensitive member is represented by the difference of the thickness of the surface film of the photosensitive member after printing of 1000 sheets (1K sheets) from that before practice of the printing. The thickness of the surface film was measured by an eddy current type thickness tester (Inscope MP3, Fischer Co.).

TABLE 1

| Charging | Hardness | | Surface rough- | Wearing by printing of |
|---|---|---|---|---|
| Roller | A | B | ness | 1K sheets |
| 80 | 35 | 54 | 6 μm | 0.6 μm |
| 80a | 35 | 46 | 10 μm | 1.0 μm |

As described above, the charging roller 80 of the present invention reduced the amount of wearing of the photosensitive member by 40% in comparison with the comparative charging roller 80*a*, thereby enabling elongation of the life of the photosensitive member.

EXAMPLE 2 AND COMPARATIVE EXAMPLE 2

The same laser beam printer as in Example 1 was used in this Example and this Comparative Example. The process speed was changed to about 150 mm/sec, and the charging roller described below was brought into contact with the photosensitive member. To the charging roller, AC voltage of frequency of 1500 Hz and DC voltage of about −700 V were applied in superposition. The $V_{PP}$ was controlled to be the same as in Example 1.

Figure 10:
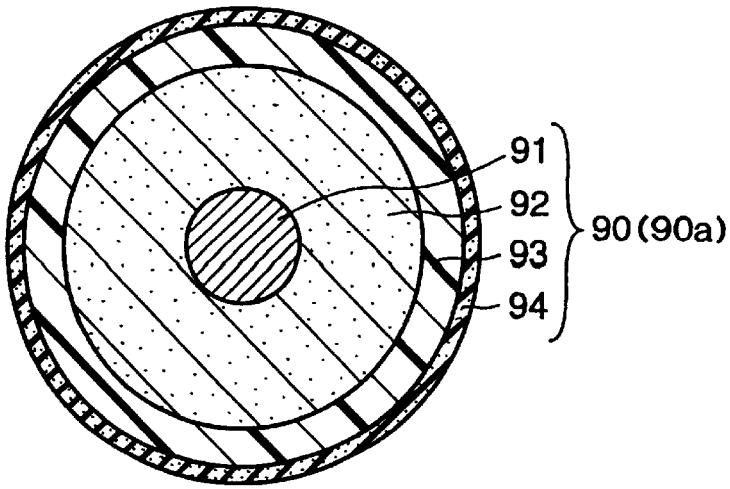
FIG. 10 is a schematic sectional view of the charging roller employed in Example 2.

FIG. 10 is a sectional view showing the layer constitution of the charging roller 90 of the present invention. This charging roller 90 has three layers: an elastic layer 92, coating layers 93, 94 arranged in the named order successively on an electroconductive support 91 serving as a power supplying electrode, and is 14 mm in outside diameter and 310 mm in length. The charging roller 90 is prepared by expanding and vulcanizing the elastic layer 92, then forming the coating layers 93 and 94 by dip coating.

In the constitution shown in FIG. 10, the electroconductive support 91 is a nickel-plated steel bar of 8 mm in diameter, the elastic layer 92 is an expanded urethane sponge containing electroconductive carbon black dispersed therein, having resistivity of $10^6$ Ω·cm and thickness of 3.0 mm. The coating layer 93 is a urethane-acrylic resin containing electroconductive carbon black dispersed therein and having thickness of 250 μm and resistivity of $10^7$ Ω·cm. The coating layer 94 is a nylon resin containing electroconductive carbon black and electroconductive titanium oxide dispersed therein and having thickness of 10 μm, and resistivity of $10^8$ Ω·cm.

The coating layer 93 is employed to prevent exudation of oil from the elastic layer 92 and to level the non-uniform resistivity of the elastic layer 92. The coating layer 94 serves to raise the pressure resistance against the photosensitive member, to prevent soiling of the surface of the photosensitive member by the coating layer 93, and to protect the surface of the charging roller 90.

The hardness and the surface roughness of the charging roller 90 were lowered by lowering the hardness of the coating layer 93. The surface roughness (10-point average roughness) was 1.5 μm. The Asker C hardness of the elastic layer was 45°. The micro-rubber hardness of the charging roller was 55° after all the layers were formed.

Separately, another charging roller 90*a* was prepared in the same manner as the above charging roller 90 except that the coating layer 94 was not formed, and the hardness of the coating layer 93 was raised. The charging roller 90*a* had a hardness B of 70°, and the surface roughness of 4.5 μm. Therefore, the charging roller satisfied the condition of the surface roughness of not more than 8 μm, but did not satisfy the conditions for A and B.

The two charging rollers 90 and 90*a* were evaluated for the wearing of the photosensitive member. Table 2 shows the results.

TABLE 2

| Charging Roller | Hardness A | Hardness B | Surface roughness | Wearing by printing of 1K sheets |
|---|---|---|---|---|
| 90 | 45 | 55 | 1.5 μm | 0.55 μm |
| 90a | 45 | 70 | 4.5 μm | 0.80 μm |

As described above, the charging roller 90 of the present invention caused wearing in an amount of 70% of the comparative charging roller 90*a,* thereby enabling elongation of the life of the photosensitive member.

EXAMPLE 3 AND COMPARATIVE EXAMPLE 3

The same laser beam printer as in Example 1 was used in this Example and this Comparative Example. The charging roller described below was used, and brought into contact with the photosensitive drum.

Figure 11:
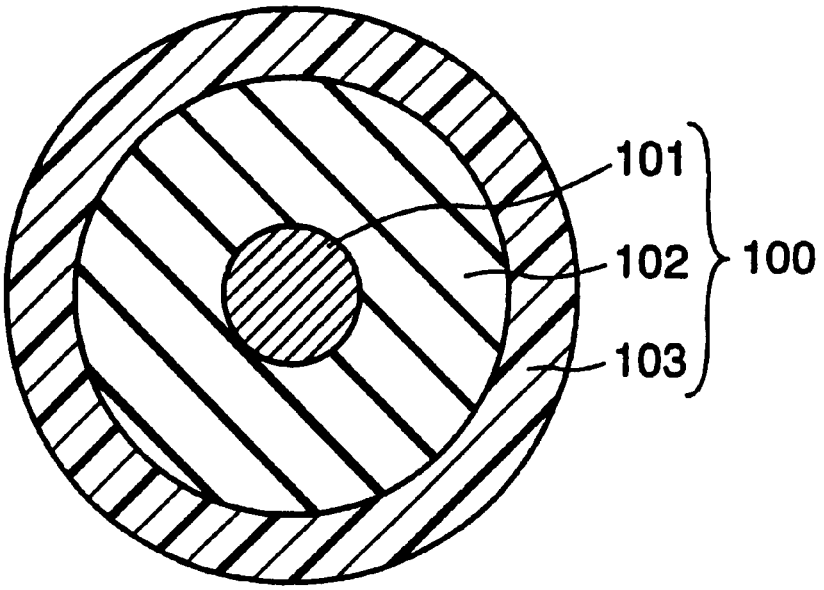
FIG. 11 is a schematic sectional view of the charging roller employed in Example 3.
Figure 12:
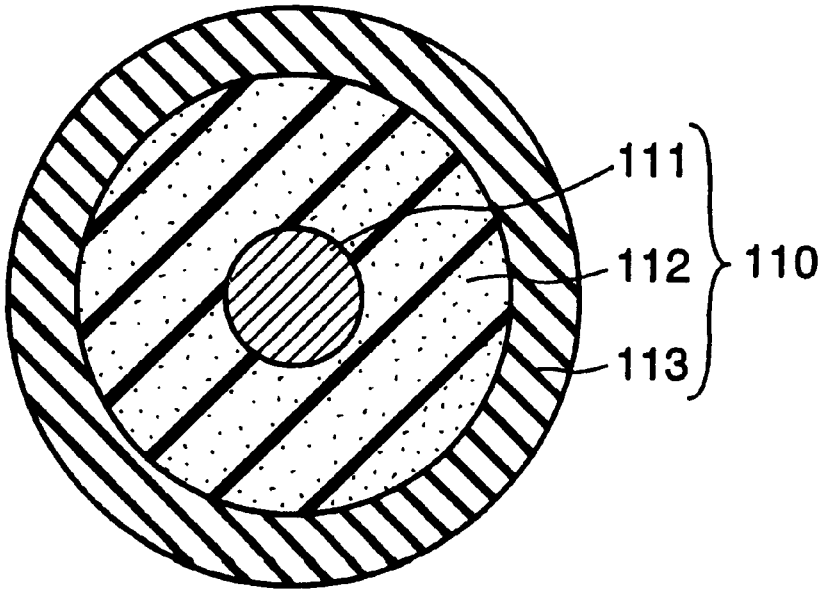
FIG.12 PRIOR ART
FIG. 12 is a schematic sectional view of a conventional charging roller.

FIG. 11 is a sectional view showing the layer constitution of the charging roller 100 of the present invention. This charging roller 100 has two layers: an elastic layer 102, a coating layer 103 arranged in the named order successively on an electroconductive support 101 serving as a power supplying electrode, and is 14 mm in outside diameter and 310 mm in length. The charging roller 100 is prepared by expanding and vulcanizing the elastic layer 102 and polishing it, then forming the coating layer 103 by dip coating. In preparation of this charging roller, the formed elastic layer 102 was polished to improve the surface properties and to obtain the surface roughness of not larger than 8 μm.

In the constitution shown in FIG. 11, the electroconductive support 101 is a nickel-plated steel bar of 8 mm in diameter, the elastic layer 102 is an expanded urethane rubber containing electroconductive carbon black dispersed therein, having thickness of 3.0 mm and resistivity of $10^6$ Ω·cm. The coating layer 103 is a urethane-acrylic resin containing electroconductive carbon black dispersed therein and having thickness of 250 μm and resistivity of $10^7$ Ω·cm.

The coating layer 103 prevents exudation of oil from the elastic layer 102 and levels the non-uniform resistivity of the elastic layer 102.

The surface roughness (10-point average roughness) of the charging roller 100 was 7.0 μm. The Asker C hardness of the elastic layer was 45°. The micro-rubber hardness of the charging roller was 62° after all the layers were formed.

The charging rollers 100, and the charging roller 90*a* of Comparative Example 2 were evaluated for the wearing of the photosensitive member. Table 3 shows the results.

TABLE 3

| Charging Roller | Hardness A | Hardness B | Surface roughness | Wearing by printing of 1K sheets |
|---|---|---|---|---|
| 100 | 45 | 62 | 7.0 μm | 0.6 μm |
| 90a | 45 | 70 | 4.5 μm | 0.8 μm |

As described above, the charging roller 100 of the present invention resulted in the amount of wearing of about 75% of the comparative charging roller 90*a,* thereby enabling elongation of the life of the photosensitive member.

COMPARATIVE EXAMPLE 4

A charging roller was prepared and evaluated in the same manner as in Example 1 except that the Asker C hardness of the elastic layer was changed to 50° by decreasing the expansion ratio of EPDM sponge. The results are shown in Table 4.

TABLE 4

| Hardness A | Hardness B | Surface roughness | Wearing by printing of 1K sheets |
|---|---|---|---|
| 50 | 65 | 6.0 μm | 0.8 μm |

What is claimed is:

1. A charging roller set in contact with a chargeable member to charge the chargeable member by application of voltage, the charging roller comprising an electroconductive support, an elastic layer formed thereon, and at least one coating layer formed on the elastic layer, wherein the charging roller has surface roughness of not more than 8 μm, and Asker C hardness (A) of the elastic layer, and micro-rubber hardness (B) of the charging roller satisfy the relations below:

$$A \leqq 45°$$

$$A<B<A+20°.$$

2. A charging roller according to claim 1, wherein the surface roughness is not less than 0.1 μm.

3. A charging roller according to claim 2, wherein the surface roughness ranges from 0.1 to 3 μm.

4. A charging roller according to claim 2, wherein the elastic layer has the Asker C hardness of not less than 10°.

5. A charging roller according to claim 4, wherein the elastic layer has the Asker C hardness ranging from 20° to 45°.

6. A charging roller according to claim 1, wherein the elastic layer has the Asker C hardness of not less than 10°.

7. A charging roller according to claim 6, wherein the elastic layer has the Asker C hardness ranging from 20° to 45°.

8. A charging roller according to claim 1, wherein the charging roller has micro-rubber hardness ranging of more than 45° but not more than 55°.

9. A charging roller according to claim 1, wherein the elastic layer has thickness ranging from 2 to 10 mm.

10. A charging roller according to claim 9, wherein the coating layer has thickness ranging from 100 to 1000 μm.

11. A charging roller according to claim 1, wherein the coating layer has thickness ranging from 100 to 1000 μm.

12. A charging roller according to claim 1, wherein the elastic layer comprises a sponge.

13. A charging roller according to claim 1, wherein the chargeable member is an electrophotographic photosensitive member.

14. A process cartridge, comprising an electrophotographic photosensitive member, and a charging roller set in contact with the electrophotographic photosensitive member to charge the electrophotographic photosensitive member by application of voltage, said-charging roller comprising an electroconductive support, an elastic layer formed thereon, and at least one coating layer formed on the elastic layer, wherein the charging roller has a surface roughness of not more than 8 μm, and Asker C hardness (A) of the elastic layer and micro-rubber hardness (B) of the charging roller satisfy the relations below:

$$A \leqq 45°$$

$$A<B<A+20°,$$

and the electrophotographic photosensitive member and the charging roller are supported integrally and are demountable from the main body of an electrophotographic apparatus.

15. An electrophotographic apparatus, comprising an electrophotographic photosensitive member, a charging roller set in contact with the electrophotographic photosensitive member to charge the electrophotographic photosensitive member by application of voltage, a light irradiation means, and a developing means, said charging roller comprising an electroconductive support, an elastic layer formed thereon, and at least one coating layer formed on the elastic layer, the charging roller having a surface roughness of not more than 8 μm, and Asker C hardness (A) of the elastic layer and micro-rubber hardness (B) of the charging roller satisfying the relations below:

$$A \leqq 45°$$

$$A<B<A+20°$$

* * * * *

UNITED STATES PATENT AND TRADEMARK OFFICE

CERTIFICATE OF CORRECTION

PATENT NO. : 6,052,549

DATED : April 18, 2000

INVENTOR(S) : Masaru SHIMURA, et al.

It is certified that error appears in the above-identified patent and that said Letters Patent is hereby corrected as shown below:

COLUMN 3:

Line 58, "of tends" should read --tends--.

COLUMN 6:

Line 24, "$10^{8\Omega\bullet cm.}$" should read --"$10^{8}\Omega\bullet$cm.--.

COLUMN 10:

Line 36, "A<B<A+20°" should read --A<B<A+20°.-.

Signed and Sealed this

Nineteenth Day of December, 2000

*Attest:*

Q. TODD DICKINSON

*Attesting Officer*

*Commissioner of Patents and Trademarks*